United States Patent [19]

Ulbrich et al.

[11] Patent Number: 4,613,060

[45] Date of Patent: Sep. 23, 1986

[54] PRESSURE-GAS OPERATED DISPENSING MEANS FOR FLUIDS

[75] Inventors: Hans-Joachim Ulbrich, Brühl; Horst Quester, Cologne, both of Fed. Rep. of Germany

[73] Assignee: Wilh. Quester Maschinenfabrik GmbH, Hurth, Fed. Rep. of Germany

[21] Appl. No.: 682,186

[22] Filed: Dec. 17, 1984

[30] Foreign Application Priority Data

Dec. 22, 1983 [DE] Fed. Rep. of Germany ..... 3346330

[51] Int. Cl.[4] ..... B67D 5/08

[52] U.S. Cl. ..... 222/61; 222/136; 222/145; 222/373; 222/399; 137/209; 137/256; 137/265; 141/5; 141/248; 141/302

[58] Field of Search ..... 222/61, 399, 394, 373, 222/145, 136, 389; 137/209, 256, 265; 239/337, 373, 372; 141/248, 302, 5, 37

[56] References Cited

U.S. PATENT DOCUMENTS

| | | | |
|---|---|---|---|
| 1,386,301 | 8/1921 | Adair et al. | 137/256 X |
| 2,669,941 | 2/1954 | Stafford | 222/373 X |
| 3,805,819 | 4/1974 | Etter | 137/209 X |

*Primary Examiner*—Joseph J. Rolla
*Assistant Examiner*—David H. Bollinger
*Attorney, Agent, or Firm*—Birch, Stewart Kolasch & Birch

[57] ABSTRACT

A gas pressure operated dispensing method and apparatus for dispensing fluids including a first container as a primary fluid source, a second container as a reserve fluid source, a first gas line connected to the first container and a second gas line connected to the second container, a gas pressure source connected to the first and second gas lines for supplying a pressurized gas thereto, a first change over valve and a second change over valve disposed in the first gas line and the second line, respectively, a supply line for introducing a fluid into the second container, a discharge line for discharging a fluid from the first container, a fluid line communicating with the supply line and the second container at one end and the discharge line and the first container at the other end, the fluid line containing a third valve, and vent line selectively connectible to the second gas line through the second change over valve when the gas pressure source is separated from the second gas line by the second change over valve.

10 Claims, 3 Drawing Figures

PRESSURE-GAS OPERATED DISPENSING MEANS FOR FLUIDS

BACKGROUND AND SUMMARY OF THE INVENTION

The present invention relates to a pressure-gas operated dispensing means for fluids comprising a first container connectible via a first gas line to a pressure gas source, and whose outlet is connected to a discharge line, and a second container also connectible to the pressure gas source via a second gas line and a first valve, which second container is connected by a fluid line to a fluid source.

It has been known, for expelling fluid from a container, e.g. for spraying fluid on a material to be treated, to use dosing pumps adapted to produce the pressure required to expel the fluid. In case of dosing pumps in the form of piston pumps, shocks and vibrations may occur so that dosing is not performed uniformly but by impact blows. If spindle pumps are used for dosing, high-frequency and stochastic vibrations are caused, thus again affecting a continuous uniform dispensing of fluid for the purpose of atomization. A continuous atomization is, for example, required for spraying flavoring agents on tobacco or for spraying fluid on textiles, etc.

It has also been known to dispense pressurized fluids from a vessel. Due to the timely and constant pressure, fluid may be dispensed uniformly, however, for refilling fluid, the pressure vessel must be loaded periodically. During the loading operation, no fluid may be dispensed. With such a batchwise filling of fluid into the pressure vessel, care must be taken that the pressure vessel contains the exact amount of fluid required. Otherwise, dispensing must be interrupted prematurely, or, alternatively upon the supply of the determined amount of fluid, a residual quantity of fluid still present in the vessel must be removed. Moreover, due to the high pressures, the use of pressure vessels are governed by strict safety requirements and form a constant source of risk.

A known dispensing means of the above mentioned type, shown in U.S. Pat. No. 1,460,389, comprises two containers, one being connected to an expansion tank and the other to a pressure tank. If one container is filled with fluid, the escaping gas expelled from said container gets into the expansion tank. The pressure tank supplies pressure gas to the other container to expel the fluid therefrom. By this means, one container may be filled while the other is emptied and vice versa. In addition to the pressure tank, the known assembly calls for an expansion tank and a compressor which removes gas from the expansion tank to condense the gas to be supplied to the pressure tank. Each of the two containers is to be connected to at least three lines. Furthermore, a high expenditure is necessary because of the number of valves required.

Accordingly, it is the object of the present invention to provide a dispensing means as described above which requires only a simple pressure gas source, e.g., the usually existing compressed air line, and which may be realized with simple devices and reduced technical expenditure.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The problem of the present invention is solved in that by a second valve, the fluid line is connected to the discharge line as well as to the first container, the second gas line being connectible to a vent line if the second gas line is separated by said first valve from the pressure gas source.

According to the present invention, the second container is a reserve tank from which fluid is pressed into the first container or into the fluid line extending out of the first container if the latter is nearly empty. During the fluid transfer from the second container into the first container, both containers connected to the pressure gas source are under equal pressure action. Thus, pressure fluctuations in the fluid line extending out of the first container are avoided. Hence, fluid is filled from the second container to the first container during the dispensing operation which need not be interrupted or changed. If the first container is filled from the second container, the second container is refilled again. To this effect, the gas line of the second container is connected to the vent line, with the fluid path from the second container to the first container being locked. Refilling of the second container may be now realized from the external fluid source until it is filled, while fluid is being continuously pressed out of the first container. In a way, the two containers form a tandem arrangement in which the first container is emptied while the second is being filled, whereas the first container is filled when the second is emptied. Preferably, the volume of both containers is approximately equal. The containers may be relatively small so that only low residual amounts of fluids are left in them when the dispensing device is disconnected. Due to the constant decanting of the containers, small container volumes are sufficient.

The pressure gas source may be the compressed air supply usually available in factories which delivers compressed air at a pressure of about 6 bar.

For decanting fluid from the second container to the first, the pressure in the second container should be somewhat higher than that in the first container. Said pressure difference may be produced in that in the gas line extending from the gas pressure source to the first container, a throttle point is provided which does not exist in the line extending to the second container.

The pressure difference required for decanting may be easily caused by mounting the second container at a level higher than the first container and by underconnecting the gas lines of both containers if the fluid line of the second container is connected to the discharge line. During the decanting phase, both containers are connected to the same gas pressure. The required pressure difference is caused by the height difference between the containers. The bottom wall of the second container is situated at a higher level than the upper wall of the first container. No additional external source for producing the pressure difference in the refilling phase is required.

On embodiment of the invention will be explained hereinafter with reference to the drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
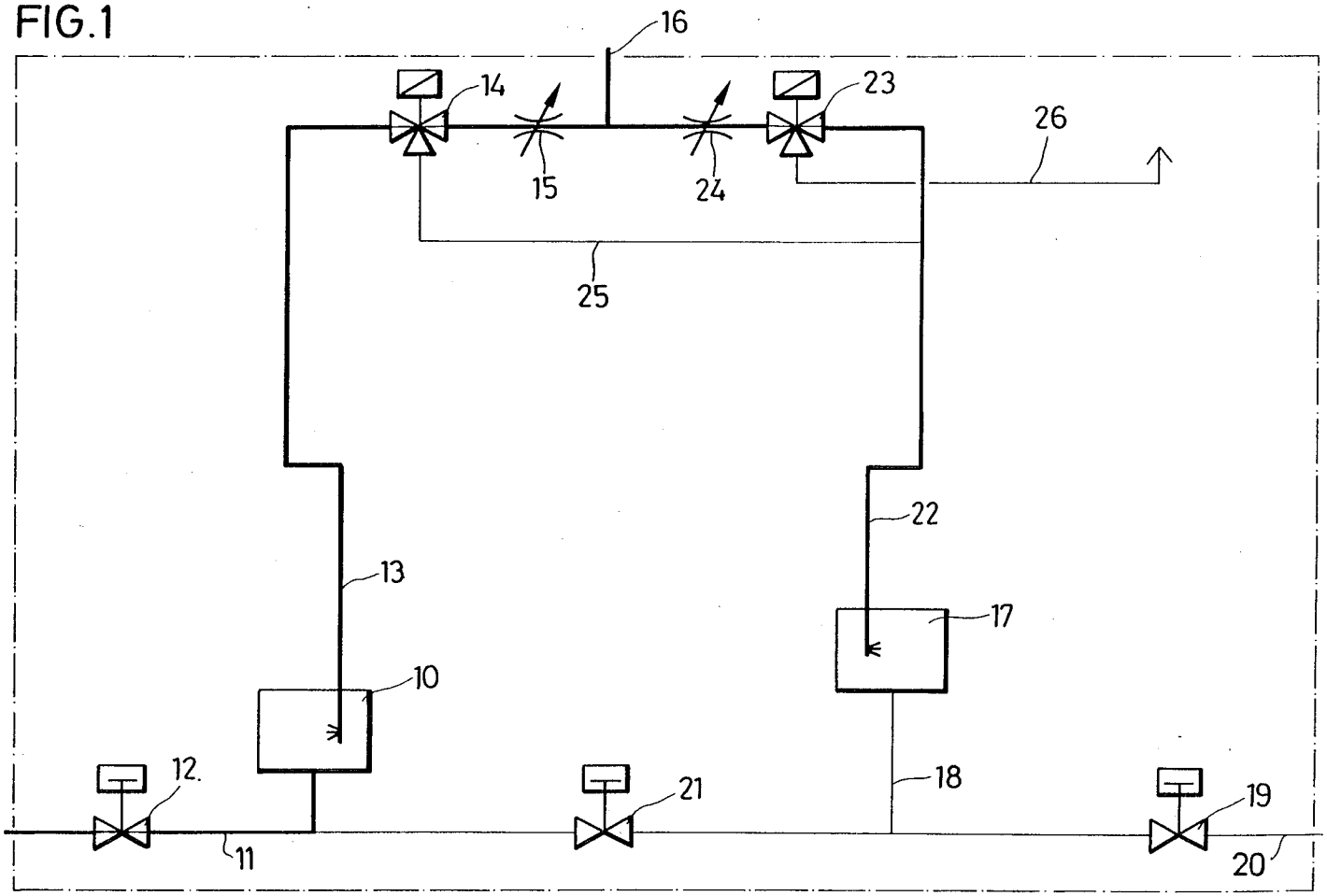
FIG. 1 is a view of the fluid and gas lines in the ready phase in which the second container being filled is waiting for the emptying of the first container.

The dispensing means for liquids comprises a first container 10 having a bottom outlet from which extends a discharge line 11 containing a shutoff valve 12 and leading to a fluid consumer, e.g. a device for uniformly spraying a fluid over a material to be treated. A gas line 13 extends from above into the first container 10 to produce in it the pressure required to expel the fluid from the first container, said gas line being connected to a pressure gas supply line 16 through an adjustable throttle device 15 and through a change-over valve 14.

The design of the second container 17 is similar to that of the first container 10. Its fluid line extends from an outlet in the bottom wall and is connected via a valve 19 to a supply line 20 extending from a (nonillustrated) fluid source, and via a second valve 21 to the discharge line 11 of the first container 10. The gas line 22 of the second container 17 can be connected via a change-over valve 23 and an adjustable throttle device 24 to the compressed-air supply line 16.

Valves 14, 19, 21 and 23 may be controlled either by a timer or by a level control responsive to the fluid levels prevailing in the containers 10 and 17.

The control of the valves is as follows:

In the stand-by phase shown in FIG. 1, gas lines 13 and 22 are connected to the compressed air supply line 16 via the change-over valves 14 and 23. Hence, both containers 10 and 17 are under pressure. Valves 19 and 21 are closed. When fluid is dispensed, valve 12 is kept open. In this phase, the fluid line 18 of the container 17 is locked, so that from said container, although it is under pressure, no fluid is pressed out. On the other hand, from container 10, fluid is being discharged under constant pressure via line 11.

Figure 2:
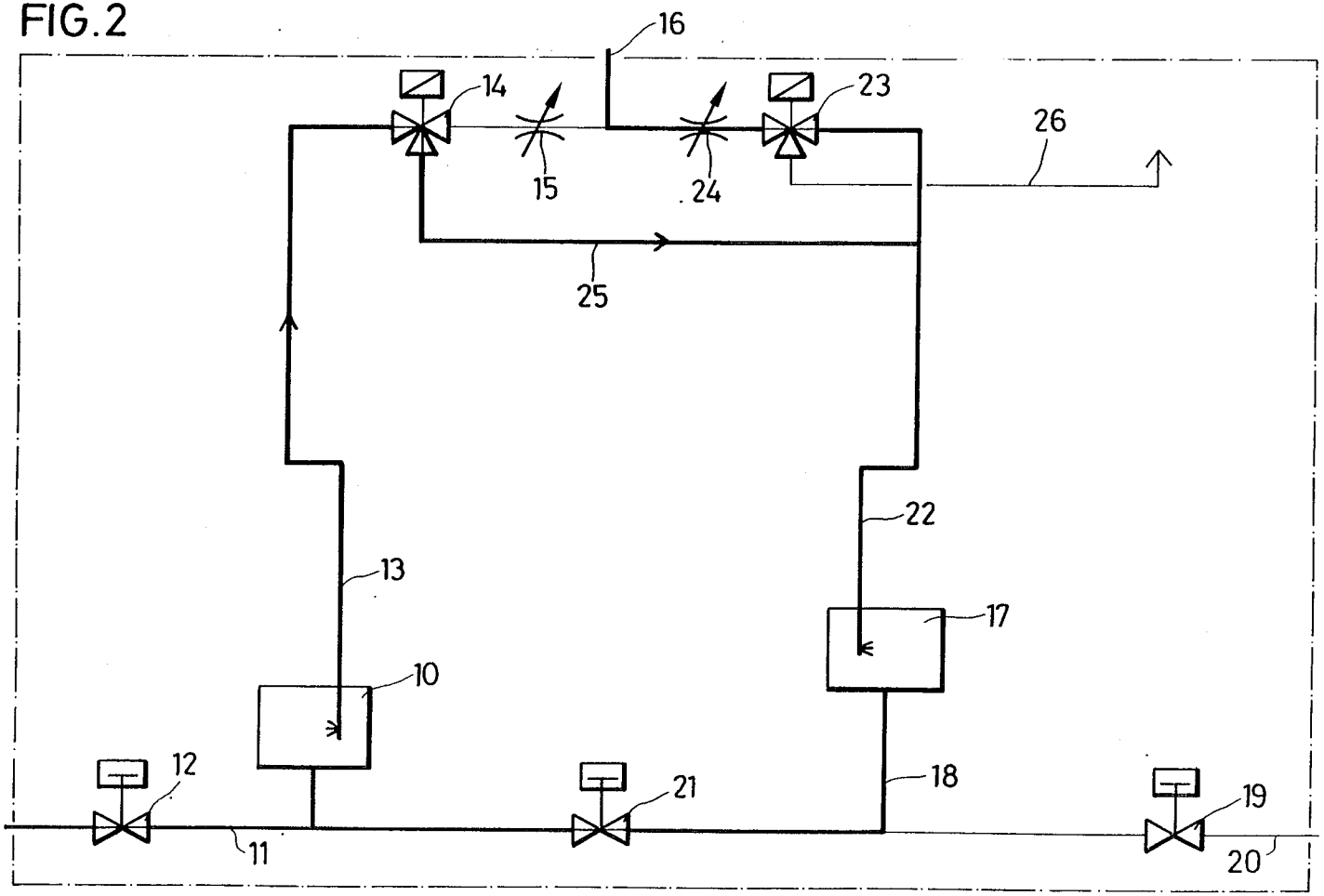
FIG. 2 shows the arrangement of FIG. 1 in the decanting phase.

When the fluid in container 10 falls to a low level, valve 21 is opened and valve 14 is changed over thus not connecting directly any longer gas line 13 to the compressed air supply line 16, but rather to a nonthrottled line 25 joined to gas line 22 (FIG. 2).

In the decanting phase (FIG. 2), the pressure gets to the gas lines 13 and 22 via the change-over valve 23 and the two containers 10 and 17 are under equal pressure.

Due to the positioning of the second container 17 higher than the first container, that is, by ensuring that its bottom wall is at a higher level than the upper wall of the first container 10, fluid contained in the second container 17 flows through the open valve 21 to the discharge line 11. Part of said fluid is discharged through the open valve 12, and the excessive portion flows upward into the first container 10 which is filled in this manner.

With respect to the amount of the pressure of the supplied compressed air, the pressure difference caused by the difference in the height of containers 10 and 17 is so small that the pressure change in the discharge line 11 is negligible.

Figure 3:
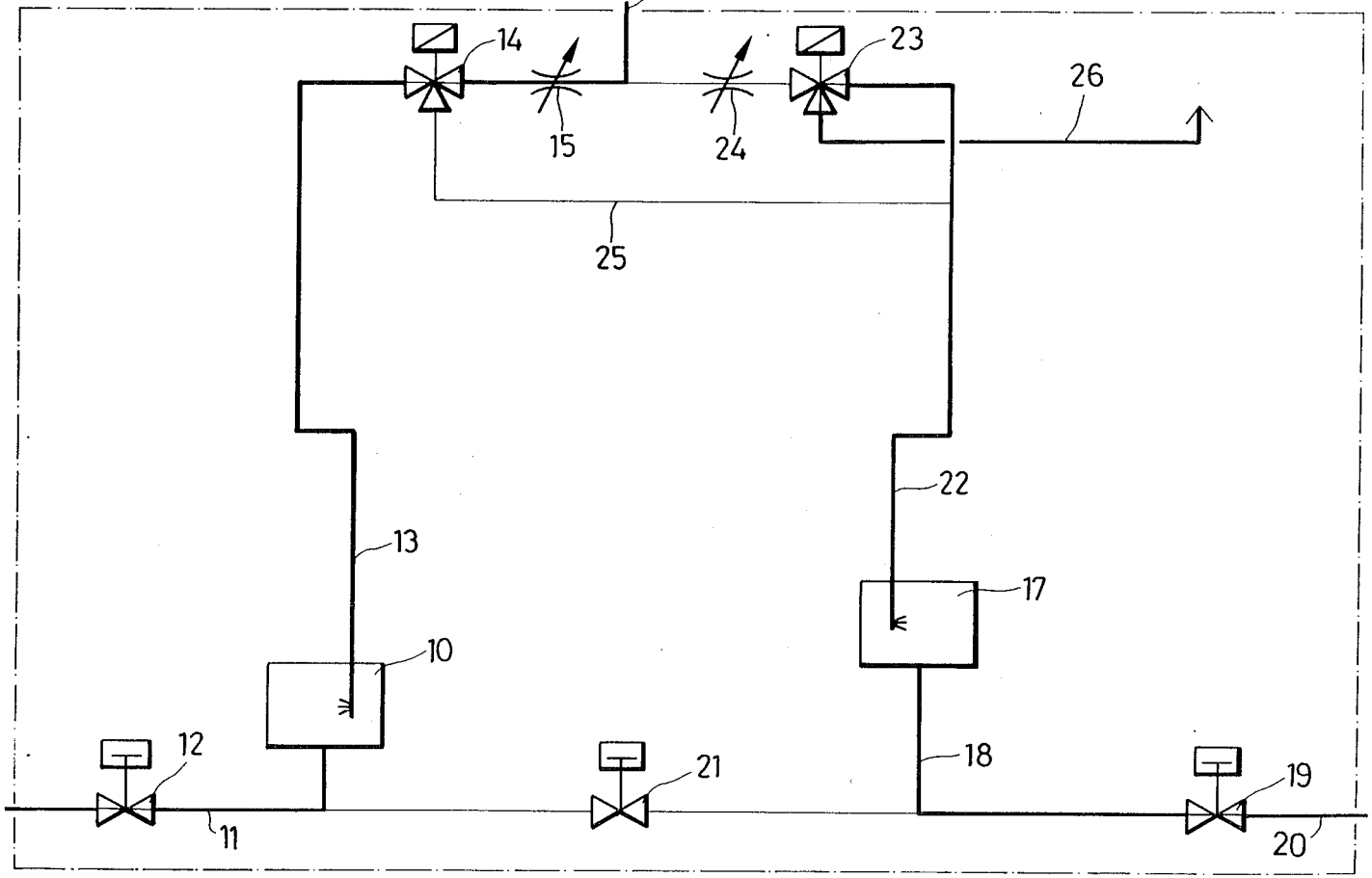
FIG. 3 shows the same arrangement during the refilling of the second container.

If, as disclosed above, the fluid included in container 17 is discharged while container 10 is refilled with said fluid, valve 21 is closed, according to FIG. 3, and valves 14 and 23 are changed over so that the gas line 13 is connected to the compressed air supply line 16 while gas line 22 is connected with a vent line 26 extending to the outside air. In this refilling phase of the second tank, line 25 is locked. The second container 17 is pressureless because it is vented via gas line 22, and, through the open valve 19 fluid flows from below through the fluid line 18 into the second container 17 which is refilled accordingly. Upon termination of the refilling operation, valve 19 is closed and the change over valve 23 connects the gas line 22 to the compressed air supply line 16 thus causing again the stand-by phase shown in FIG. 1. Fluid need only be made available by the (not-illustrated) fluid source at a reduced pressure which is less than the pressure prevailing in the first container 10.

In the decanting phase shown in FIG. 2, gas lines 13 and 22 of both containers are interconnected in nonthrottled condition via line 25. Therefore, in maintaining the full air pressure, air may flow from the first container 10 to the second container 17. By this means, an air volume equal to that expelled from the first container 10 as a result of the rising fluid level is refilled in the second container 17 in which the fluid level decreases approximately to the extent by which it rises in the first container.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas pressure operated dispensing system for dispensing fluids, which comprises:
   - a first fluid container;
   - a second fluid container;
   - means for maintaining a pressure difference between said first and second fluid containers;
   - a first gas line connected to the first container and a second gas line connected to the second container;
   - gas pressure source means connected to said first and second gas lines, for supplying a pressurized gas thereto;
   - first change over valve means and second change over valve means disposed in said first gas line and said second line, respectively, for controlling gas flow through said first and second gas lines;
   - supply line means for introdicuing a fluid into said second container;
   - discharge line means for discharging a fluid from said first container;
   - fluid line means for communicating with the supply line means an outlet of, the second container, the discharge line means and an outlet of the first container, said fluid line means containing a third valve means disposed between the outlet of said second container and the outlet of said first container; and
   - vent line means, selectively connectible to said second gas line through said second change over valve means when said gas pressure source is separated from said second gas line by said second change over valve means for venting said gas line to the atmosphere.

2. The gas pressure operated dispensing system of claim 1, wherein said means for maintaining a pressure difference comprises a positional height difference between said first and second fluid containers.

3. The gas pressure operated dispensing system of claim 2, wherein the first and second gas lines of said containers are interconnected when the fluid line means communicating with the second container is connected to the discharge line means.

4. The gas pressure operated dispensing system of claim 1, wherein additional conduit means are provided for connecting the first and second gas lines.

5. The gas pressure operated dispensing system of claim 4, wherein the additional conduit means is a nonthrottled gas line.

6. The gas pressure operated dispensing system of claim 1, wherein an adjustable throttle device is provided in the first and second gas lines.

7. The gas pressure operated dispensing system of claim 1, wherein a valve control means is provided for controlling all of said valve means, said valve control means being responsive to the fluid levels prevailing in the first and second container.

8. The gas pressure operated dispensing system of claim 7, wherein said valve control means is a timer.

9. The gas pressure operated dispensing system of claim 7, wherein said valve control means is a level control.

10. A method for dispensing fluids utilizing two containers holding fluids, a first conduit means for supplying gas pressure to said containers and a second conduit means for supplying and discharging a fluid to and from said containers, which comprises the steps of:

(1) applying gas pressure to a first container to force said fluid from the container, through the discharge line and out of the system into the environment;

(2) applying gas pressure to a second container to force said fluid from the second container to fill the first container, (3) applying gas pressure to the first container to force fluid from said first container, through the discharge line, and out of the system into the environment simultaneously with step (2); and (4) venting the second container out of the system into the environment while supplying a fluid to the second container.

* * * * *